United States Patent [19]

Hirabayashi et al.

[11] 4,032,674

[45] June 28, 1977

[54] MAGNETIC MEMORY STRUCTURE AND METHOD OF MAKING THE SAME

[75] Inventors: Masaya Hirabayashi, Kyoto; Hiromasa Enjo, Gamo, both of Japan

[73] Assignee: Kyoto Ceramic Co., Ltd., Kyoto, Japan

[22] Filed: Jan. 14, 1975

[21] Appl. No.: 540,968

Related U.S. Application Data

[63] Continuation of Ser. No. 265,457, June 30, 1972, abandoned.

[52] U.S. Cl. ..... 427/130; 252/62.55; 252/62.59; 252/62.63; 252/62.64; 340/174 TF; 427/380; 428/539; 428/900

[51] Int. Cl.[2] ..... B05D 5/12

[58] Field of Search ..... 427/128, 130, 380; 428/539, 900; 252/62.55, 62.59, 62.63, 62.64, ; 340/174 TF

[56] References Cited

UNITED STATES PATENTS

| | | | |
|---|---|---|---|
| 3,245,062 | 4/1966 | Kornei | 360/131 |
| 3,404,026 | 10/1968 | Skudera et al. | 427/130 |
| 3,441,429 | 4/1969 | Hacskaylo | 252/62.51 |

FOREIGN PATENTS OR APPLICATIONS

| | | | |
|---|---|---|---|
| 1,125,091 | 3/1962 | Germany | 427/130 |

*Primary Examiner*—George F. Lesmes
*Assistant Examiner*—Stanley S. Silverman
*Attorney, Agent, or Firm*—Spensley, Horn and Lubitz

[57] ABSTRACT

A magnetic memory structure which may be used as a disc memory, a drum memory or a similar component including a ceramic substrate having a thin film of magnetic ferrite material thereon, said film being of a cobalt-based spinel type ferrite and a method for manufacturing the same.

13 Claims, 5 Drawing Figures

MAGNETIC MEMORY STRUCTURE AND METHOD OF MAKING THE SAME

INTRODUCTION

This is a continuation of application Ser. No. 265,457, filed June 30, 1972, now abandoned.

This invention relates to a magnetic memory structure used as a disc memory, a drum memory, etc., in an electronic computer, electronic switching system and the like and more particularly to a magnetic memory structure having a thin film (that can be formed to a thickness of about 0.1 $\mu$ at the minimum) and a method of manufacturing the same.

BACKGROUND OF THE INVENTION

Referring now to the prior art in this field of engineering with reference to a disc memoory by way of example, the disc memory of a conventional type is of the construction in which magnetic paint prepared by mixing fine powder of $\gamma$-$Fe_2O_3$ with an epoxy resin or other binding agents has been applied to a metallic aluminium disc and then hardened by being heated to a hardening temperature of the binding agent so as to fix the $\gamma$-$Fe_2O_3$ to the aluminum disc. This conventional type disc memory thus obtained has the following problematic points with respect to the article or with respect to the method of manufacture.

1. With respect to the article:

a. A ferrite film depends upon the hardness of the binding agent used for its surface hardness and, generally speaking, it is liable to damage by the contact friction of a magnetic head for writing or reading. This may result in the film not only reducing the capacity of the magnetic memory but often may cause the detachment of the film from the magnetic memory, losing the memory capacity of the memory structure entirely. Particularly, when it becomes necessary to bring the magnetic head as near the memory as possible in order to increase memory density, the damage which thus may be caused by the head to the magnetic medium is not to be ignored.

b. Because fine powder of $\gamma$-$Fe_2O_3$ is dispersedly fixed in the bonding agent, care must be taken to disperse the powder very uniformly or otherwise there is likely to be produced discrepancy in memory characteristics. In this case, caution must be used in the dispersibility and also uniformity of grain diameter and grain shape of fine powder of $\gamma$-$Fe_2O_3$. Such thorough uniformalization is a very difficult task from a viewpoint of mass production, and in this sense the intended uniformalization ultimately results in increased cost of production. In any event, uniformity of quality in the end product is difficult to obtain.

c. The magnetic memory structure according to the binding agent application and drying method is limited to film thicknesses such that the thinnest possible film obtainable should not be less than about 5 $\mu$. As film thickness is increased, memory density is reduced as is well known (thickness loss).

2. In respect to a method of manufacture:

a. Grinding was necessary to smooth the surface of the ferrite film after the binding agent was hardened, and this grinding required much skill and lacked productivity. In addition, a thin film was very difficult to obtain as described above in Item (c).

b. As described in Item (1.) (b), it was extremely difficult to uniformalize the grain diameter, size and dispersilibity of $\gamma$-$Fe_2O_3$ powder, and accordingly in order to obtain a uniform product, productivity was reduced and production cost had to be inevitably increased.

There have been numerous unsuccessful attempts to solve some of these problems, such as that shown in "Chemical Deposition and the Formation of Mixed Ferrite Films" by William L. Wade, Jr., et al., December 1964, AD 611–774; "Formation and Deposition of Ferrite Films" by William L. Wade, Jr., et al., February 1962, AD 282–515; and the U.S. patent applications showing the same Ser. No. 26,579 filed Apr. 8, 1970, and Ser. No. 95,692 filed Dec. 7, 1970, by Bernard Jacobs, et al.

The present inventors faced with such problematic points have developed, after various research and tests, an entirely new magnetic structure for discs, etc., which overcomes the disadvantages of the kinds described and a method of manufacturing the same.

SUMMARY OF THE INVENTION

Accordingly, a primary object of this invention is to provide a magnetic memory structure including a ceramic substrate which has overcome the disadvantages mentioned in Items (a), (b) and (c) and which is less than 0.1 $\mu$ in film thickness, high in hardness and uniform in memory characteristics (6000 BPI).

Another object of this invention is to provide a magnetic memory structure capable of being varied to a certain degree apart in principle from coercive Hc or residual magnetic density $B_R$ in said memory structure.

Still another object of the invention is to provide a magnetic memory structure in which a magnetic hysteresis loop can be made rectangular.

Still another object of the invention is to provide a method of manufacturing a magnetic memory structure by which a ferrite film can be manufactured by merely applying an aqueous solution of metallic salt which is a magnetic material to a ceramic substrate and heat treating the ceramic substrate and which method can dispense with mechanical working and is of great advantage to a method of manufacture.

Other objects and advantages of this invention will become more apparennt from preferred embodiments and photographic substitutes for drawings.

BRIEF DESCRIPTION OF THE DRAWINGS

The accompanying photographic substitutes for drawings illustrate the oscillographic curves according to B-H loop tester in the embodiments of the invention.

DETAIL DESCRIPTION OF INVENTION

Figure 1:
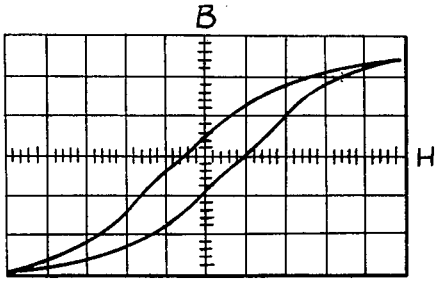
FIG. 1 shows a magnetic hysteresis loop in Example 1.

The memory structure of the invention is generally made up of a substrate and a ferrite film formed on the substrate, said substrate being of high purity alumina ($Al_2O_3$) ceramics or other ceramics similar in characteristic property thereto, namely, ceramics which is high in density and which does not impair the memory characteristcs of ferrite through its reactions with ferrite even at high temperatures in the range of 1000° to 13000° C at which the ferrite is synthesized, said ferrite film being of cobalt-based spinel type ferrite represented by a general formula $CO_{(1-x)}Fe_{(2+x)}O_4$ (wherein $-0.2 \leqq x \leqq 0.3$). This cobalt-spinel type ferrite film is entirely different from the conventional type film to which magnetic paint was applied and hardened. Namely, the cobalt-based spinel type ferrite in the invention is produced by high-temperature sintering of a film of iron and cobalt oxides (this film is a very smooth and close oxide film produced from eutectoid). The oxide film is formed by applying a mixture of an aqueous solution of iron salt and an aqueous solution of cobalt salt to the substrate and drying the same, subjecting the salts of iron and cobalt in the substrate to thermodecomposition by heating the substrate to a temperature of higher than 200° C, preferably higher than 400° C and thus sufficiently depriving the salts of iron and cobalt of their water solubility. Because the ferrite film is formed from the oxide film that has been formed by applying an aqueous solution to the substrate and heat treating the same but not by use of an adhesive agent, the ferrite film makes it possible to obtain a memory material of a fine crystalline aggregate of ferrite and which is high in surface hardness, very thin in film thickness and free from discrepancy in memory characteristics, and high in memory density. Moreover, because the substrate itself is of ceramics or similar material, the strength of the thin ferrite film itself is also reinforced from the back of the film and becomes very strong, with the result that the drawbacks of the aforestated type inherent in the prior art memory can be removed at once. On the other hand, stated also in respect of a method of manufacture, it is advantageous that the invention has made it possible to obtain a ferrite film of uniform density without the necessity of considering the size, grain diameter, dispersity, etc. of the material to be used. This is accomplished by the method of applying to the substrate an aqueous solution of iron and cobalt salts mixed according to a stoichiometrical ratio so that the composition represented by the aforementioned general formula may be obtained and by heat treating the substrate thus coated with the aqueous solution. Because the ferrite film as described above is produced intermediately from a film of oxide produced from an eutectoid, the film can provide a very close and highly smooth film, offer the great advantage that the film can dispense with grinding and can thoroughly remove the disadvantages of the prior art disc memory.

A description will now be made of the invention with reference to the disc memory shown by way of example. First, the material used in the disc substrate in the invention must be a material such as alumina ceramics, which is high in density and does no deteriorate the memory characteristics of a ferrite film through its reactions with a cobalt-based spinal type ferrite film. Among the other ceramic materials having such a property are included zirconia ceramics, mullite ceramics, spinel ceramics, etc. Alumina ceramics, as well known, are the highest of ceramic materials in mechanical strength and are not only stabilized in strength (even at high temperature in the range of 1000° to 1300° C at which ferrite is produced) but also they do not deteriorate the memory characteristics of the ferrite film even by slight dispersion at high temperature through the ferrite film. Such are the characteristics of the ferrite film that the film is most suitable for use as the ceramic substrate of the invention. Needless to say, it would be impossible to obtain the disc memory of the invention by use of a conventional metallic aluminum substrate if the substrate were used according to the invention, because exposure of the aluminum substrate to the aforestated high temperatures would melt the aluminum substrate by heat and disperse the same in a substantial degree at high temperatures through the ferrite to thereby deteriorate the memory characteristics of the ferrite film.

The means by which a disc of alumina ceramics and other ceramics is formed is unimportant to this aspect of the invention and accordingly various known means can be freely used. However, the most preferred method of forming is to effect compression molding of the powder of said ceramic material while heating the powder at high temperature (re hot pressing). Namely, the ceramic disc is formed by heating and pressure application at the same time. By so doing, the density (bulk specific gravity) of the ceramic powder filler becomes very great at an increasing rate, and sintering progresses easily until true specific gravity of this powder material has been attained, and thus the sintering ends while it is progressing. The ceramic substrate thus obtained leaves no room to permit the production of bubbles inside, with the result that the substrate is free from pits produced due to the bubbles. Because the increase in density is comp completed by the heat treatment made at relatively low temperatures and in a short time, grain growth of the powder during the heat treatment can be arrested so that the growth may be as little as possible. A smooth flawless surface can be obtained by grinding and lapping the surface of the ceramic substrate. The ferrite film is formed on the smoothly lapped surface of the ceramic substrate by a method to be later described.

A description will be made of a concrete example of molding such a ceramic substrate with reference to alumina ceramics. In order to expedite sintering and to arrest crystal growth, 0.1% (by weight) of MgO is added to alumina (grain diameter of 0.3 – 1.0 $\mu$) of over 99.9% purity and the mixture is filled into a graphite mold and pressure of 200kg/cm$^2$is applied to the mold and the mold is heated by a high-frequency induction furnace to a temperature of 1600° C and thus sintering is completed after the mold has been maintained at said temperature and under said pressure for 30 minutes. Thus, a sintered body of 3.98 in bulk specific gravity and 2 – 5 $\mu$in grain diameter of alumina crystal is obtained. And lapping of the sintered body can produce an entirely flawless smooth surface. As described above, since the alumina ceramic substrate is originally superior in its mechanical property, it is desirable for the purpose of the invention of making the memory as thin as possible that the thickness of ceramics be normally in the range of 2 – 5 mm.

Referring now to the method of forming a cobalt-based spinel type ferrite film, iron and cobalt each are made into an aqueous solution of their salts, mixed according to a stoichiometrical ratio and applied to the substrate. The iron and cobalt each are made to be present as an ion in said aqueous solution by use of the aqueous solution type iron and cobalt. It is one of the great characteristic features of this invention that the iron and cobalt each are made to be mixedly present in the form of an ion in said aqueous solution. And by this type of aqueous solution an advantage is provided of not only enormously increasing the effect of mixing iron and cobalt in comparison with the mixture of powdered oxides, but also enabling sintering of ferrite in a relatively low temperature range (below 1300° C). The salts of iron and cobalt must be water-soluble salts and nitrate is the most suitable of this type of salts. The reason is that nitrate is thermally decomposed at low temperature (200°– 400° C) into oxides of iron and cobalt with its solubility lost. Other water-soluble salts, for example, sulfate, can also be used according to the invention, but it is high in temperature of decomposition (about 700° C) and hence somewhat inferior in workability. The respective percentages of mixture of the water-soluble iron salt and water-soluble cobalt salt are to be selected according to a stoichiometrical ratio in which the composition of end ferrite may form the percentage expressed by the aforestated general formula. The application of the mixed solution may be carried out by spraying, brush painting or other known application means.

In order to form a specified thickness of coated film, it is desirable to employ a multiple-layer method in which a first coating layer of film is made into an oxide film by the heat treatment to be later described and then a new mixed solution is applied to the oxide film thus formed. (The reason for recommending the multiple-layer method will later be described.) When a thin film thickness of magnetic medium answers the purpose of a write-in electric current as it does in the case of a high-frequency current, one or a small number of mixed solution applications and subsequent heat treatment alone will complete the production of a specified thickness of a ferrite film, but in other cases it is desirable to use the aforestated multiple-layer method. The first heating to be carried out after the aqueous solution of salts of iron and cobalt was applied and dried must be made at a temperature sufficient to thermally decompose each salt in a mixed aqueous solution of salts of iron and cobalt and to deprive the salt of its water solubility and form an oxide film of iron and cobalt. When the thermal decomposition, as will later be described, starts at about 200° C and is raised to a temperature higher than 400° C in the case of nitrate of iron and cobalt, the respective strong oxide films of iron and cobalt are formed and the object of forming oxides is attained in a relatively low temperature range, with the result that good workability is provided. In order to subject the oxide film thus obtained to thermochemical reation thereafter so as to change the oxide film into a cobalt-based spinel type ferrite film, high-temperature sintering is necessary, and the temperature required is in the range of 1000° to 1300° C which is sufficient for the desired purpose, and which is lower than the temperature conventionally required at which solid oxides of iron and cobalt are burnt and formed into ferrite.

To give greater detail of the explanation so far made, reference will now be made to the specific process. The respective aqueous solutions of nitrates of iron and cobalt are mixed according to the aforestated stoichiometrical ratio. The mixing ratio must be determined in the light of the memory characteristics of the ferrite film to be obtained. This mixed aqueous solution is uniformly applied to the alumina ceramic substrate in a thickness of about 10 $\mu$, dried and heated to a temperature of over 200 C, preferably over 400° C, and namely to a temperature at which said nitrates are thermally decomposed into oxides and the oxides form a strong film on the substrate until the solutibility possessed by the nitrates is lost. Then said application of aqueous solution to the substrate, drying and heating of the solution applied substrate are repeated. The repetition of this operation provides the desired thickness of an oxide film. The film having the specified thickness is thereafter sintered by use of a high-temperature kiln to a temperature at which a strong cobalt-based ferrite film is formed on the surface of the ceramic substrate through thermochemical reaction of the oxides. By so doing a ferite is solidly formed on the surface of the ceramic substrate, said ferrite being a cobalt-based spinel type ferrite film exceedingly high in surface hardness, uniform in film thickness, very high in memory density and of a fine crystalline (granular) aggregate of ferrite of a grain diameter of less than 3 $\mu$. In this heating process, an aqueous solution of nitrate applied to the substrate starts in the first place to evaporate the water of the solution, which is a solvent, by drying, but when the heating is raised to the neighborhood of 50° C, the nitrates of iron and cobalt strat melting into a complete eutectic solution without being formed into a crystal mixture and which covers the surface of the substrate very smoothly. And when the heating is further raised to a temperature of over 100° C, the nitrates are quickly decomposed into oxyhydroxides and then decomposed into oxides in the neighborhood of 200° C losing water solubility completely. And when the temperature is still further increased to over 400° C, the oxides thus produced turn into a very strong oxide film of a thickness of about 0.1$\mu$ and fast stick (e.g., intimately adhere) to the substrate with such stableness that the oxide film does not react with the subsequent new aqueous solutions applied thereto. A laminated product of a uniform, close and strong multiple-layer film is formed in this manner by the repeated applications of the aqueous solution and repeated heating thereof. The laminated film thus produced, by the laminating effect of film according to the method of the invention, is completely free of the possible defects of the film formed by one layer application to a thickness equal to the final thickness of film formed by the multiple-layer method. Such possible defects may take the form of a nonuniformity of film thickness, exfoliation of film due to condensation of the heated film or the possible presence of bubbles due to containment of a volatile gas, such as nitric acid gas, produced during thermal decomposition of nitrate. By sintering the oxide film thus obtained at a temperature of over 1000° C, a strong, close, fine crystalline and homogeneous cobalt-based spinel type ferrite film is formed on the surface of the ceramic substrate through thermochemical reactions between the oxides. Also in this case, while a conventional method of synthesizing ferrite by which a mixture of powdered oxides alone is sintered is a method based on a solid phase reation between solid grains of a micron order, the method according to the invention, because the starting material used is a mixed solution in an ion state in an aqueous solution, is far superior in mixing efficiency. Accordingly, the former needs a high temperature of about 1350° C also with respect to the temperature of formation of ferrite in time of sintering, while the latter starts formation of ferrite already in the neighborhood of 1000° C and completely finishes the formation at a relatively low temperature of below 1300° C.

Now, a description will be made of the range of composition and memory characteristics of the cobalt-based spinel type ferrite film of the invention. The composition of the ferrite film is basically expressed by a general formula $Co_{(1-x)}Fe_{(2+x)}O_4$ and is within the range of composition in which the value of $x$ in the formula is varied in the range of $-0.2 \leqq x \leqq 0.3$. This ferrite film is excellent in output as a memory medium, for example, 200 – 600 Oe. (Oersted) in Hc (coercive force) and more than 1000 G. (Gauss) in $B_R$ (residual magnetic flux density). If, in this connection, the value of $x$ in this formula is less than −0.2, then Hc becomes less than 200 Oe. and $B_R$ becomes less than 1000 G. and the read-out output of the memory is reduced, while on the other hand, if the value of $x$ exceeds 0.3, $B_R$ is again reduced to less than 1000 G. and thus not only the read-out output of the memory is reduced but also Hc is increased over 600 Oe. and becomes too large and also too difficult to erase, and the write-in current of the memory must be increased in a substantial degree, with the result that this increase proves a great hindrance to the design of a memory system device. Accordingly, it becomes necessary for the composition of the ferrite film of the invention to have the composition of the general formula expressed by the aforestated range. Furthermore, not only because the ferrite film of the invention can be formed into a far thinner one than the conventional film but also because the film itself is of a completely fine crystalline aggregate of high density spinel type ferrite, it is exceedingly high in memory density and very high in hardness, and therefore even if the head should come in direct contact with the surface of the film, the film is quite free damage for a long time, with the advantageous result that the distance between the disc surface and the head can be greatly shortened. The combined advantages of the kind described make it possible for the invention to have memory characteristics of 6,000 BPI or higher, while the memory characteristics of conventional product does not exceed about 2,500 BPI at most (the number of bits per inch . . . the same to be applied hereinafter).

The above has been a description of the basic process of the invention and the magnetic memory structure obtained thereby. The present inventors have fully realized the interesting fact that the element obtained by the application of the following additional means to the above process proved more effective. Namely, one fact is that the composition of the ferrite film of the invention, as described above, is $Co_{(1-x)}FE_{(2+x)}O_4$ (wherein $-0.2 \leqq x \leqq 0.3$), but the ferrite film in which less than 0.2 mol of Co in the range of this composition is substituted by at least one kind of transition metals selected from Cu, Be, Mg, Ca, Sr, Ba, Zn, Cd, Mn and Ni or the ferrite film in which less than 1% (by weight) of at least one kind of metallic oxides selected from $LiO_2$, $SiO_2$, $TiO_2$, $GeO_2$, $ZrO_2$, $SnO_2$, $HfO_2$, $V_2O_5$, $Nb_2O5$, $Ta_2O_5$, $MoO_3$ and $WO_3$ is added to and contained as a microconstituent in the ferrite indicated by said composition can, in addition to the aforestated memory characteristics imparted to the ferrite film, vary the values of Hc and $B_R$ independent of each other by the substitution of a part of Co or by the addition of said metallic oxides, and hence that the ferrite film of the invention can fully meet the magnetic requirements for the design of the write-in and read-out machine in which the memory structure is used. Namely, if a quantity ratio of Fe to Co in the invention is changed within the above range of $x$, Hc and $B_R$ cannot be varied independent of each other but are varied interdependently and inseparably from each other and thus it is impossible to arrest only one of Hc and $B_R$ at required design value and to vary the other alone. But because the aforestated substitution elements or additive oxides makes it possible to increase independently the value $B_R$ alone with little or no relation to Hc, there comes out the practical utility enough to meet the required value of design. For example, as apparent from Examples 2 and 3 that follow, substitution of a part of co by Zn makes it possible to increasee $B_R$ without effecting little or no change in Hc, and similarly substitution of Co by Cd, Mn and Ni serves to increase $B_R$ and substitution of Co by Cu, Be, Mg, Ca, Sr and Ba is effective for an increase in Hc, while on the other hand the addition of Mo and other metallic oxides mentioned serves to increase $B_R$ and $Mo_3$, $WO_3$, $V_2O_5$, $Nb_2O_5$ of the oxides serves to slightly drop the termperature of sintering, respectively. When the quantity of the substitution elements and additive metallic oxides departs from the aforestated limiting range, the effect of addition becomes insufficient or works contrarily, and accordingly observance of said limiting range is necessary. A method of substitution is either to mix an aqueous solution of water-soluble salt(s) of the substitution element(s) with an aqueous solution of water-soluble salts of iron and cobalt, or to dissolve water-soluble salt(s) of substitution element(s) directly into the mixed aqueous solution of salts of iron and cobalt, or add oxide(s) of substitution element(s) to the mixed aqueous solution of iron and cobalt. In the case of oxide(s), all that is necessary is to add a specified quantity in fine powder of less than 1 $\mu$ to a mixed aqueous solution of the respective salts or iron and cobalt. In this manner, the substitution of a part of Co and addition of metallic oxides are a highly effective means in the sense described above.

Another aspect of this invention is that improvements can be made in input and output characteristics and also in self-demagnetizing effect by making a magnetic hysteresis loop rectangular by adding such oxides as will later be described to the magnetic memory structue of the invention. Such addition of oxides for making the loop rectangular is effective in the addition of a small amount of less than 5% to the aforestated memory structure (including the substitution of a part of Co in the composition by substitution elements and/or the addition of oxides) and real aspect of making the hysteresis loop rectangular will be apparent from the accompanying photographs.

The additions effective for making the magnetic hysteresis loop rectangular in this invention are the following oxides. Namely they are metallic oxides or nonmetallic oxides represented by a general formula $M_2O_3$ wherein M represents at least one kind of elements selected from B, Al, Sc, Ga, Y, In, lanthanide elements (rare earth elements) and Tl as a third group element, As, Sb, and Bi as a fifth group element, and Cr . . . as a sixth group element. Said metallic oxides or nonmetallic oxides are added preferably in fine powdered form to an aqueous solution of mixed salts for forming the aforestated ferrite at such a stoichiometrical rate at which the aqueous solution may contain said metallic or nonmetallic oxides in the amount of less than 5% (by weight) of the composition of ferrite. The inventors are not aware of the theoretical background of the reason why the abovementioned oxides indicated by $M_2O_3$ are effective for making the hysteresis loop rectangular, but they roughly draw the following inference. Cobalt-based spinel type ferrite film of this invention is a sintered body of $CoO—Fe_2O_3$, and accordingly it is considered that, when any of the oxides cited which take oxide coordination similar to this $Fe_2O_3$ is added, it will result in entering a spinel crystalline structure by sintering and M will impart some form of distortion related with a crystalline structure to the lattice structure of Fe. And the reason follows why the cited elements of the aforestated third, fourth and fifth groups are selected. In each of the groups, elements most effective for making the hysteresis loop rectangular are selected from the elements belonging to the fourth through sixth periodic systems and in the case of the third group, such elements are Sc, Ga, Y, In, lanthanide elements and Tl, an in the case of the fifth group, they are As, Sb and Bi (but since V, Nb, Ta of group *a* of the fifth group are of $M_2O_5$ type, they are excluded from the oxides of this invention), and in the case of the sixth group, they include only Cr of group *a* (since Mo, W of group *a* of the sixth group and Se, Te of group *b* of the sixth group are of $MO_3$ type, they are likewise excluded). Oxides $B_2O_3$ and $Al_2O_3$ of B and Al (third group) as elements other than those of the fourth through sixth periodic systems do not by themselves shown such manifest results as the cited oxides in making the hysteresis loop rectangular, but when they are present together with other cited oxides, they help those cited oxides make their hysteresis loops rectangular and produce a synergic effect on the cited oxides. The reason why actinide was excluded from the elements of the third group seems to lie in the fact that actinide is larger in ion radius than Fe and is difficult to enter the spinel crystalline structure so as to be of use for making the hysteresis loop rectangular. The reason why the amount of inclusion in ferrite of the oxides $M_2O_3$ of the elements thus selected is limited to 5% is that an excess of the oxide content over 5% produces the saturated part which cannot enter the crystalline structure and that the saturated part is left as an excess product and, as a result, functions as a diluting material and reduces Hc and $B_R$ per unit thickness of ferrite.

In order to add the oxides selected in the manner described above to ferrite as an additive for making the hysteresis loop rectangular, the oxides, as described, are added in fine powder preferably of less than 1 $\mu$ to a mixed aqueous solution of iron and cobalt for forming ferrite. Application of the mixed solution to the substrate is carried out by the same method as that described above. The oxides as an additive for making the hysteresis loop rectangular enter the crystalline structure of ferrite, as described, by sintering the ferrite and prove effective for making the hysteresis loop rectangular. Thus, the magnetic hysteresis loop is made rectangular, and the cobalt-based spinel type ferrite film, which is exclusively of an aggregate of fine crystals (grain) of ferrite of less than 3 $\mu$ in grain diameter and improved in output characteristics and transfer effect, is solidly formed on the surface of the ceramic substrate. It is readily understood that, when substitution of a part of Co by transition metals capable of varying each of the described Hc and $B_R$ independently of each other in principle or addition of metallic oxides is used in combination with an additive for making the magnetic hysteresis loop rectangular, such combined use can provide a memory material of high fidelity that can impart wide variations to the memory characteristics obtained. A description will now be made of the invention with reference to examples of the invention.

EXAMPLE 1

50.00 g. of aqueous solution of 135 g. ferric nitrate and 70 g. deionized water (distilled water will do) was mixed with 15.88 g. of aqueous solution of 135 g. cobalt nitrate and 70 g. deionized water, and the resultant mixture was applied in layers of a film thickness of 10 $\mu$ to a 99.5% high purity alumina substrate of $Al_2O_3$ of 75 mm $\phi$ and 3 mm t, dried and held for 5 minutes on a nichrome wire heating plate (generally called a hot plate) having a surface temperature of 500° C and then cooled. The film thickness formed in this case was 0.1 $\mu$. . After this procedure had been repeated ten times, the film and substrate thus treated were heated at 1200° C for 1 hour in an electric furnace using silicon carbide as a heating element. The film thus treated became $Co_{0.9}Fe_{2.1}O_4$ in terms of the aforestated chemical composition ratio, and was a very high purity cobalt-based spinel type ferrite film having 420 Oe. in Hc, 1100 G. in $B_R$, 1$\mu$ in thickness and 1 – 2$\mu$ in crystal diameter. When the disc memory thus obtained was used as a memory medium for a computer, there was no change in the output value of read-out up to 6000 BPI in memory density.

EXAMPLE 2

50.00 g. of aqueous solution of 135 g. ferric nitrate and 70 g. deionized water (distilled water will do), 15.09 g. of aqueous solution of 135 g. cobalt nitrate and 70 g. deionized water and 0.35 g. of aqueous solution of 135 g. zinc nitrate and deionized water were mixed. The resultant mixture was applied by the same procedure as that of Example 1 to a substrate of high purity aluminum, dried and sintered to thereby obtain a cobalt-based spinel type ferrite film having a chemical composition of $Co_{0.88}Zn_{0.02}Fe_{2.10}O_4$ formed on the substrate. The film thus obtained was a very high density film having 400 Oe. in Hc, 1300 G. in $B_R$, 1 in film thickness, 1 – 2 $\mu$ in crystal grain diameter. Similarly, the film, when used as a memory medium for a computer, showed no change in the output value of read-out up to 6000 BPI in memory density. As apparent from this example, substitution of a part of Co by Zn can increase $B_R$ with little or no change effected in Hc.

EXAMPLE 3

0.3635 g. of aqueous solution of cadmium nitrate consisting of 135 g. cadmium nitrate and 70 g. deionized water was added to 50.00 g. aqueous solution of ferric nitrate and 15.09 g. aqueous solution of cobalt nitrate in Example 2. The resultant mixture was applied by the same procedure as that of Example 1 to an alumina substrate, dried, and sintered to thereby obtain a cobalt-based spinel type ferrite film having a chemical composition of $Co_{0.88}Cd_{0.02}Fe_{2.1}O_4$ formed on the substrate. The film thus obtained was a film of high memory density having a thickness of 1 $\mu$, a crystal grain diameter of 1 – 2 $\mu$, a coercive force of 400 Oe. and a residual magnetism ($B_R$) of 1400 G. Similarly, the film, when used as a memory medium for a computer, showed a memory density of 6000 BPI. As apparent from this example, Cd also serves to increase in $B_R$ in the same way as Zn.

EXAMPLE 4

0.035 g. of fine powder (less than 1 $\mu$) of molybdenum trioxide ($MoO_3$) was added to 50 g. of mixed aqueous solution of ferric nitrate and cobalt nitrate in Example 1. The resultant mixture was applied by the same procedure as that of Example 1 to a high purity alumina substrate, dried and sintered to thereby obtain a cobalt-based spinel type ferrite film having a chemical composition of $Co_{0.9}Fe_{2.1}O_4$+0.5% (by weight) of $MoO_3$. The film obtained was a very high memory density film having a coercive force of 380 Oe., a residual magnetism ($B_R$) of 1180 G., a film thickness of 1 $\mu$ and a crystal grain diameter of 1 – 2 $\mu$. The film, when used as a memory medium for a computer, showed no change in the output value of read-out up to 6000 BPI in memory density. As apparent from this example, $MoO_3$ serves to increase $B_R$ as compared with Example 1.

EXAMPLE 5

In obtaining the memory structures to be shown in the following Examples 5 to 8, contrast examples that constitute references for the memory structures were obtained by almost the same compounding ratio and exactly the same procedure as that of Example 1. Namely, 50.00 g. of aqueous solution of 135 g. ferric nitrate and 70 g. deionized water was mixed with 15.09 g. of aqueous solution of 135 g. cobalt nitrate and 70 g. deionized water. The mixture thus obtained was applied by the same procedure as that of Example 1 to a high purity alumina substrate, dried and sintered to thereby obtain a cobalt-based spinel type ferrite film formed on the substrate, said film having a chemical composition of $CO_{0.9}Fe_{2.1}O_4$ and having a coercive force of 420 Oe. and a residual magnetism of 1100 G. In Example 5, was directly added 0.156 g. of barium nitrate $Ba(NO_3)_2$ to 50 g. of mixture of the aqueous solution of ferric nitrate and cobalt nitrate in the above contrast example. The resultant mixture was then used in the same manner as the contrast example to thereby obtain a ferrite film having a chemical composition of $Co_{0.88}Ba_{0.02}Fe_{2.1}O_4$. The film thus obtained was not much different in residual magnetism of 1150 G. from the film of the contrast example but was 510 Oe. in coercive force, showing an increase over 420 Oe. of the latter.

EXAMPLE 6

0.056 g. of zirconium dioxide $ZrO_2$ was added to 50 g. of mixed aqueous solution prepared by changing the amount of aqueous solution of cobalt nitrate in the above contrast example into 15.88 g. and sintered. The composition of the film obtained after the sintering was $Co_{0.9}Fe_{2.1}O_4$ + 0.8% (by weight) of $ZrO_2$, and 1300 G. in residual magnetism, showing a great increase over 1100 G. of the contrast example and was 420 Oe. in coercive force, making little or no change as compared with the contrast example.

EXAMPLE 7

0.156 g. of barium nitrate Ba $(NO_3)_2$ and 0.035 g. of $V_2O_5$ were added to 50 g. of mixed aqueous solution of said contrast example and sintered. The composition of the film obtained after the sintering was $Co_{0.88}Ba_{0.02}Fe_{2.1}O_4$ + 0.5% (by weight) an $V_2O_5$, and and was 1400 G. in residual magnetism, considerably increased as compared with 1100 G. of the contrast example and was 500 Oe. in coercive force, showing a slight increase.

EXAMPLE 8

0.035 g. of zirconium dioxide $ZrO_2$ and 0.035 g. of niobium pentoxide $Nb_2O_5$ were added to 50 g. of mixed aqueous solution of said contrast example and sintered. The composition of the film obtained after the sintering was $Co_{0.9}Fe_{2.1}O_4$ + 0.5% (by weight) respectively of $ZrO_2$ and $Nb_2O_5$, and 1550 G. in residual magnetism, which was the greatest of all the examples in the amount of increase in residual magnetism and was 350 Oe. in coercive force, showing a trend to slight increase in coercive force.

EXAMPLE 9

Figure 2:
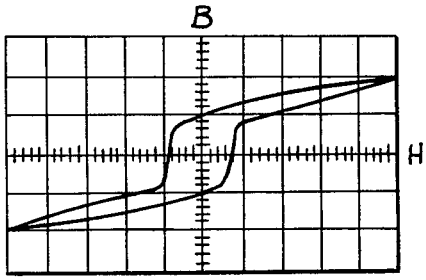
FIGS. 2 through 5 show magnetic hysteresis loops in embodiments of the invention shown in Example 9 through 12, respectively.

As a contrast example 2 of each of the following Examples 9 through 14 (except Example 13) was applied Example 1. These Examples (9 – 14) shown examples, respectively in which a magnetic hysteresis loop is made rectangular. Yttrium oxide $Y_2O_3$ was added in the following manner to the mixed aqueous solution obtained in the mixing ratio shown in Example 1. 0.056 g. $Y_2O_3$ was added to 50 g. of mixed solution of Example 1 and the mixture obtained was applied in a film thickness of 1 $\mu$ under the same sintering conditions as that of Example 1. The composition of the film obtained was $Co_{0.9}Fe_{2.10}O_4$ + 0.8% (by weight) of $Y_2O_3$, and was 430 Oe. in coercive force, 1200 G. in residual magnetism and described the magnetic hysteresis loop shown in FIG. 2. As apparent from this photograph, the addition of $Y_2O_3$ made a marked effect on making the magnetic hysteresis loop rectangular in the center of the hysteresis loop.

EXAMPLE 10

Figure 3:
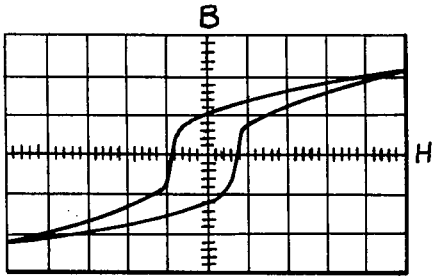

0.014 g. of antimony trioxide $Sb_2O_3$(0.02%) was added to 50 g. of mixed solution of Example 1, to obtain a memory structure under the same sintering and film thickness conditions as those of Example 1. The composition of the film obtained was $Co_{0.9}Fe_{2.1}O_4$ + 0.2% (by weight) of $Sb_2O_3$, and was 430 Oe. in coercive force, 1360 G. in residual magnetism and described the magnetic hysteresis loop shown in FIG. 3. It was apparent from this example that the addition of $Sb_2O_3$ also was effective for making the middle part of the hysteresis loop rectangular in the same manner as the addition of $Y_2O_3$.

EXAMPLE 11

Figure 4:
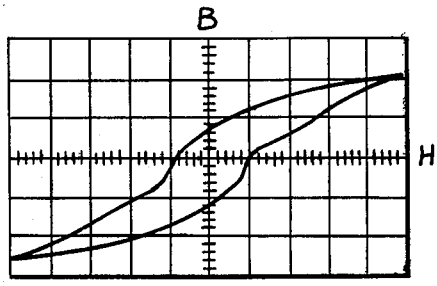

0.315 g. of chromic oxide $Cr_2O_3$ was added to 50 g. of mixed solution of Example 1 and was treated under the same sintering and film thickness conditions as those of Example 1. The composition of the film obtained was $Co_{0.9}Fe_{2.1}O_4$ + 4.5% (by weight) of $Cr_2O_3$, and was 450 Oe. in coercive force, 1150 G. in residual magnetism and described such a magnetic hysteresis loop as shown in FIG. 4. As apparent from this example, the addition of $Cr_2O_3$ also functioned in the same manner as that of $Sb_2O_3$ or $Y_2O_3$ but was slightly lower in effect.

EXAMPLE 12

Figure 5:
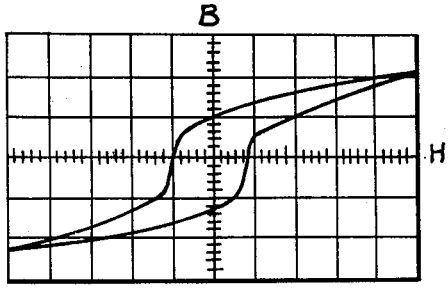

0.014 g. of $Sb_2O_3$ and 0.056 g. of $ZrO_2$ in fine powder of less than 1 $\mu$ were added to 50 g. of mixed solution of Example 1 and treated under the same sintering and film thickness conditions as those in Example 1 to thereby obtain a memory structure. The resultant composition was $Co_{0.9}Fe_{2.1}O_4$ + 0.2% (by weight) of $Sb_2O_3$ + 0.8% (by weight) of $ZrO_2$, and was 480 Oe. in coercive force, 1500 G. in residual magnetism and described such a magnetic hysteresis loop as shown in FIG. 5. As apparent from this example, the addition of $ZrO_2$ further increase rectangularity ratio (both in coercive force and in residual magnetism) in a rectangular hysteresis loop as compared with that of Example 10.

EXAMPLE 13

0.17 g. of strontium nitrate, $Sr(NO_3)_2 \cdot 4H_2O$ and 0.056 g. of $Y_2O_3$ were added to 50 g. of mixed solution of 50.00 g. aqueous solution consisting of 135 g. ferric nitrate and 70 g. deionized water with 150.00 g. aqueous solution consisting of 135 cobalt nitrate and 70 g. deionized water, and the resultant mixture was applied to form a ferrite film of the same thickness as that of Example 1 and was sintered at 1180° C for 1 hour. The composition of the resultant film was $Co_{0.88}Sr_{0.02}Fe_{2.10}O_4$ + 0.8% (by weight) of $Y_2O_3$, and was 500 Oe. in coercive force and 1200 G. in residual magnetism. As apparent from this example, the substitution in part of Co by Sr improved coercive force greater than that of Example 9.

EXAMPLE 14

0.056 g. of $Y_2O_3$ and 0.035 g. of stannic oxide $SnO_2$ were added to 50 g. of mixed solution of Example 1, and the sintering conditions and the thickness of the ferrite film were the same as those of the contrast example. The composition of the resultant film thickness was $Co_{0.9}Fe_{2.1}O_4$ + 0.8% (by weight) of $Y_2O_3$+ 0.5% (by weight) of $SnO_2$ and was 430 Oe. in coercive force and 1450 G. in residual magnetism. As apparent from this example, the addition of $SnO_2$ improved the film in residual magnetism as compared with Example 9.

The above description has been made of several most preferred forms of the invention with reference to a disc memory, but the invention also includes the following modifications thereof:

i. Partial addition of fine crystalline ferrite powder obtained as by coprecipitation to an aqueous solution of salt to be used.

ii. Sintering in the air is, in principle, a rule for a sintering atmosphere, but where necessary, application of excessive partial pressure of nitrogen is effective for suppression of growth of ferrite crystals, and hence sintering is effected under partial pressure of nitrogen.

iii. The disc memory may be replaced by a drum memory and other similar memories.

iv. Other replacements, modifications and additional means may be possible without departing from the scope and spirit of the appended claims.

As will have been understood from the description so far made, the advantages of this invention can be summarized as follows:

I. In the way of an article:

A. A cobalt-based spinel type ferrite film, which is a fine crystalline aggregate of ferrite and is high in hardness and can be produced in a thin film (to a degree of less than 0.1 $\mu$), is excellent and uniform in memory characteristics and high in memory density, and combination of these characteristics can provide the memory structure of the invention with a high performance and good quality memory hving 6000 BPI or higher, a value which cannot be expected from a prior art type memory structure.

B. The memory structure of the invention, even though generally thin, is a solid memory structure, because it is lined with a solid ceramic substrate.

C. Substitution of a part of Co by transition metals such as Cd, Cu and Be and addition of metallic oxides such as $MoO_3$ and $WO_3$ make it possible to vary $B_R$ and Hc independently of each other, and accordingly make it possible to extensively meet the requirements for the memory characterisitics of a memory - reproducing machine to be used.

D. Because the hysteresis loop made markedly rectangular in the middle thereof by the application of additives for making the hysteresis loop rectangular improves both output characteristics and transfer effect, the memory structure of the invention impart great changes to magnetic characteristics through the additional effects brought about by the treatment in Item (C).

II. In the way of a method of manufacture:

E. Because the invention makes it possible to form a ferrite film by the application and heat treatment alone without resorting to grinding of the film, it can dispense with all of machining that requires a skilled art.

F. Because it is contemplated by the invention that the magnetic material is not dispersed throughout an adhesive agent but is applied in the form of an aqueous solution of the material, no consideration as to the shape size and dispersibility of the material is required at all, with the result that it makes manufacture and handling very easy, making itself convenient for mass production together with the effects mentioned in Item (D).

G. Because the ferrite film is sintered and formed at a temperature relatively lower than that at which powder of solid oxides has conventionally been sintered, the ferrite film of the invention is more advantageous for production.

H. Because Items E - G, as above provided by the invention make production very simple both in the way of manufacture and in the way of control of process, production cost can be reduced by the introduction of mass production.

This invention is very useful and finds wide application as a magnetic memory structure of electronic computer, electronic switching systems, etc., and as a method of manufacturing the same.

We claim:

1. A method of manufacturing a magnetic memory structure characterized in that the method comprises the steps of applying a mixed aqueous solution of the respective water-soluble salts of iron and cobalt to a substrate of alumina ceramics, drying said solution and heating said solution to between 200 to 500° C to thermally decompose the respective salts in the solution thereby to deprive the solution of its water so as to form a film of oxides of iron and cobalt on said substrate, said mixed aqueous solution being mixed at a stoichiometrical rate so that said film on said substrate is represented by a general formula $Co_{(1-x)}Fe_{(2+x)}O_4$ (wherein $+0.2 \leqq x \leqq 0.3$), sintering said film at temperatures approximately below 1300° C to subject said oxides to thermochemical reactions thereby forming a solid cobalt-based spinel type ferrite film on said substrate.

2. The method of claim 1 wherein said mixed aqueous solution is mixed with the water-soluble salts of transition metal elements selected from Cu, Be, Mg, ca, Sr, Ba, Zn, Cd, Mn and Ni so that the composition of ceramics may ultimately be represented by a general formula $Co_{(1-x)}Fe_{(2+x)}O_4$ (wherein $-0.2 \leqq x \leqq 0.3$) and may be substituted in the amount of less than 0.2 mol of Co in the range of said formula by at least one kind of said transition metal elements, said oxides of iron and cobalt substituted in part by said transition elements.

3. The method of claim 1 wherein said mixed aqueous solution is mixed with at least one kind of powder of metal oxides selected from $LiO_2$, $SIO_2$, $TiO_2$, $GeO_2$, $ZrO_2$, $SnO_2$, $HfO_2$, $V_2O_5$, $Nb_2O_5$, $MoO_3$ and $WO_3$ so that the composition of ceramics may ultimately be represented by a general formula $Co_{(1-x)}Fe_{(2+x)}O_4$ (wherein $-0.2 \leqq x \leqq 0.3$) and may contain said metal oxides in the amount corresponding to 1% (by weight) of the composition represented by the formula, said oxides of iron and cobalt additionally containing powder of said metal oxides.

4. The method of claim 1 wherein said mixed aqueous solution is mixed with at least one kind of powder of oxides of metal elements of nonmetal elements selected from B, Al, Sc, Ga, Y, In, La, Tl, As, Sb, Bi and Cr so that the composition of ceramics may ultimately be represented by a general formula $Co_{(1-x)}Fe_{(2+x)}O_4$ (wherein $-0.2 \leqq x \leqq 0.3$) and may contain said metal oxides in the amount corresponding to 5% (by weight) of the composition represented by the formula, said oxides of iron and cobalt being additionally containing powder of said metal oxide.

5. The method of claim 1 wherein said solution application, drying and heating is performed a number of times to obtain a selected thickness of the oxide film.

6. A method of manufacturing a magnetic memory structure having improved Oersted and Gauss values comprising:

a. forming a mixture of an aqueous solution of a cobalt salt and an aqueous solution of an iron salt;
b. applying said mixture to an alumina substrate;
c. heating said substrate to a temperature to greater than 200° C so as to cause said salts to react and to form a continuous oxide film on said ceramic substrate, said film having a composition represented by the formula $Co_{(1-x)}Fe_{(2+x)}O_4$ (wherein $-0.2 \leqq x \leqq 0.3$) and
d. sintering said oxide film to thermally decompose said respective salts thereby changing said oxide film into a cobalt- based spinel type ferrite film.

7. The method of claim 6 wherein said salts of iron and cobalt are selected from the group consisting of nitrates and sulfates.

8. The method of claim 7 wherein said mixture of aqueous salts includes a water soluble salt of the metal elements selected from the group consisting of Cu, Be, Mg, Ca, Sr, Ba, Zn, Cd, Mn and Ni such that the composition of said ferrite film is represented by the formula $Co_{(1-x)}Fe_{(2+x)}O_4$ wherein ($-0.2 \leqq x \leqq 0.3$) and less than 0.2 moles of Co in said formula is substituted by at least one of said metal elements.

9. The method of claim 8 wherein said metal element is selected from the group consisting of Zn, Cd, and Ba.

10. The method of claim 6 wherein said mixture of aqueous salts is applied a predetermined number of times and heated after each application so as to obtain a film of a predetermined thickness.

11. The method of claim 6 wherein said oxide film is sintered at a temperature range of about 1000° to 1300° C.

12. The method of claim 6 wherein said mixed aqueous solution is mixed with at least one kind of powder of metal oxides selected from $LiO_2$, $SiO_2$, $TiO_2$, $GeO_2$, $ZrO_2$, $SnO_2$, $HfO_2$, $V_2O_5$, $Nb_2O_5$, $Ta_2O_5$, $MoO_3$ and $WO_3$ such that the composition of said ferrite film is represented by the formula $Co_{(1-x)}Fe_{(2+x)}O_4$ (wherein $-0.2 \leqq x \leqq 0.3$) and contains said metal oxides in the amount corresponding to 1% (by weight) of the composition represented by said formula.

13. The method of claim 6 wherein said mixed aqueous solution is mixed with at least one kind of powder of oxides of metal elements of nonmetal elements selected from B, Al, Sc, Ga, Y, In, La, Tl, As, Sb, Bi and Cr such that the composition of said ferrite film is represented by a general formula $Co_{(1-x)}Fe_{(2+x)}O_4$ (wherein $-0.2 \leqq x \leqq 0.3$) and contains said metal oxides in the amount corresponding to 5% (by weight) of the composition represented by said formula.

* * * * *